US007665616B1

(12) United States Patent
Hobbie

(10) Patent No.: US 7,665,616 B1
(45) Date of Patent: Feb. 23, 2010

(54) HOLDER AND DISPLAY DEVICE

(76) Inventor: Matthew M. Hobbie, 3569 Longmeadow Dr., Sarasota, FL (US) 34235

( * ) Notice: Subject to any disclaimer, the term of this patent is extended or adjusted under 35 U.S.C. 154(b) by 110 days.

(21) Appl. No.: 11/974,791

(22) Filed: Oct. 16, 2007

(51) Int. Cl.
*A47F 7/06* (2006.01)

(52) U.S. Cl. ..... 211/31

(58) Field of Classification Search ..... 211/30–33, 211/70.6, 85.3, 50; 223/84, 24, 25, 85, 14; 248/74.3, 73; 24/67.3, 67.9, DIG. 9, 563, 24/570, 336
See application file for complete search history.

(56) References Cited

U.S. PATENT DOCUMENTS

| | | | | | |
|---|---|---|---|---|---|
| 4,708,271 | A | * | 11/1987 | Grommes | 223/25 |
| 5,086,931 | A | | 2/1992 | Cobb | |
| 5,163,589 | A | * | 11/1992 | Biehl | 223/24 |
| 5,244,102 | A | | 9/1993 | Koenig | |
| 5,450,967 | A | | 9/1995 | Mallory | |
| 5,480,073 | A | | 1/1996 | LaManna | |
| D368,806 | S | * | 4/1996 | Sparaco | D32/58 |
| 5,624,041 | A | * | 4/1997 | Van Druff et al. | 211/30 |
| 5,685,465 | A | * | 11/1997 | Berardis | 223/84 |
| 5,727,694 | A | | 3/1998 | Larson | |
| 5,758,779 | A | | 6/1998 | Atkins | |
| 5,908,146 | A | * | 6/1999 | Levin | 223/84 |
| 5,921,403 | A | * | 7/1999 | Coffaro | 211/32 |
| 6,311,879 | B1 | | 11/2001 | Rigler et al. | |
| 6,422,400 | B1 | | 7/2002 | Miller | |
| D493,963 | S | * | 8/2004 | Alves | D6/320 |
| 6,824,027 | B2 | | 11/2004 | Frey | |
| 6,840,411 | B2 | * | 1/2005 | Fritz | 223/24 |
| 6,892,894 | B2 | | 5/2005 | Aiken | |
| 7,146,687 | B2 | * | 12/2006 | Kaim | 24/67.3 |
| 2006/0107495 | A1 | * | 5/2006 | Kaim | 24/67.3 |
| 2007/0039903 | A1 | * | 2/2007 | Aiken | 211/30 |
| 2008/0296240 | A1 | * | 12/2008 | Napier | 211/30 |

* cited by examiner

*Primary Examiner*—Jennifer E. Novosad
(74) *Attorney, Agent, or Firm*—Charles J. Prescott

(57) ABSTRACT

A cap holder and display device for caps having a bill. The base of the device has a display surface and, attached thereto, a plurality of arcuately formed spaced apart bands, each of which is connected at each end thereof to, and extending generally orthogonally from, the display surface. Each of the bands preferably include two symmetrically spaced apart slots formed into a top edge thereof. Each band is arcuately configured and, in conjunction with the display surface, supportively receives, establishes and retains, the curved shape of the bill of one cap. The slots are arranged to receive, establish and retain the substantially straight distal edge of the bill of another cap. An elongated groove is preferably formed into the display surface beneath one of the bands to receive and retain the squeezed together side edges of a bill of one cap which has been folded in half lengthwise.

6 Claims, 5 Drawing Sheets

28
18
34
16
14
26
12
20
10
$C_2$
14a
$B_2$

HOLDER AND DISPLAY DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for storing baseball-style caps having a bill, and more particularly to a wall-mounted cap holder and display device which both shapes and retains the unique shape of the bill while facilitating display of each of the caps.

2. Description of Related Art

Baseball-style caps having a frontal bill are extremely popular and provide both eye and face shade as well as an opportunity to show pride in an athletic team, location or the like by the display attached to the front of the cap. Applicant is aware of numerous cap receiving racks and display devices, some of which simply facilitate cap storage while others are intended to cause the bill of the cap to be shaped into a unique desired configuration and held in that position until removed from the device.

U.S. Pat. No. 6,824,027 to Frey teaches a device for shaping the brim of a sports cap, having two grooves of different curvatures, the shaper being incorporated into a variety of systems for display. Koenig discloses a cap-receiving device with slots provided for the receipt of the bill of a cap in U.S. Pat. No. 5,244,102. The cap-receiving member described in the '102 patent has a generally elliptical outer surface extending from the flat back surface in generally parallel relation to the elliptical slot.

Rigler, et al. teaches a cap storage and bill shape maintenance device in U.S. Pat. No. 6,311,879, the device including a plurality of generally horseshoe-shaped bill slots. The device of the '879 patent stores a plurality of caps for future use while maintaining the shape of the bill of each cap. A wall-mounted device for holding stacked baseball-style caps is disclosed in U.S. Pat. No. 5,086,931 to Cobb and U.S. Pat. No. 6,892,894 to Aiken discloses a cap rack for storing and displaying baseball caps which may be installed on a vertical or horizontal surface. Mallory teaches a collapsible hat display stand for holding caps which is easy to package, assemble and carry in U.S. Pat. No. 5,450,967.

A brim-forming cap holder is taught by Atkins in U.S. Pat. No. 5,758,779 which will hold baseball style caps forming the brim into a rolled state and LaManna discloses a holder for caps including a base and a plurality of contoured clamp members for insertion of the cap bill therebetween. Miller teaches a brimmed cap storage and display device having a hollow cylindrical member for cap bill insertion therein in U.S. Pat. No. 6,422,400 and Larson describes a hat holder stand for supporting the bill of a cap in U.S. Pat. No. 5,727,694.

The foregoing examples of the related art and limitations related therewith are intended to be illustrative and not exclusive. Other limitations of the related art will become apparent to those skilled in the art upon a reading of the specification and a study of the drawings.

The present invention provides yet another cap holding and display device attachable to a vertical surface and also forces the brim into a desired configuration and holds it thusly until the cap is selected for use. Additionally, any decorative logos, club or athletic team logos, geographic locations and the like attached to the front of the cap is readily viewable as part of the display feature of this invention.

BRIEF SUMMARY OF THE INVENTION

This disclosure is directed to a cap holder and display device for caps having a bill. A base of the device has a display surface and attached thereto, a plurality of arcuately formed spaced apart bands each of which is connected at each end thereof to, and extending generally orthogonally from, the display surface. Each of the bands preferably include two symmetrically spaced apart slots formed into a top edge thereof. Each band is arcuately configured and, in conjunction with the display surface, supportively receives, establishes and retains, the curved shape of the bill of one cap. The slots are arranged to receive, establish and retain the substantially straight distal edge of the bill of another cap. An elongated groove is preferably formed into the display surface beneath one of the bands to receive and retain the side edges of a bill of one cap which has been folded in half.

It is therefore an object of this invention to provide a device for holding and displaying a plurality of baseball-style caps.

Yet another object of this invention is to provide a cap holder and display device which will form and hold the bill of the cap in a particularly desired configuration to assist in permanently establishing the desired bill shape.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to illustrative rather than limiting.

DETAILED DESCRIPTION OF THE INVENTION

Figure 1:
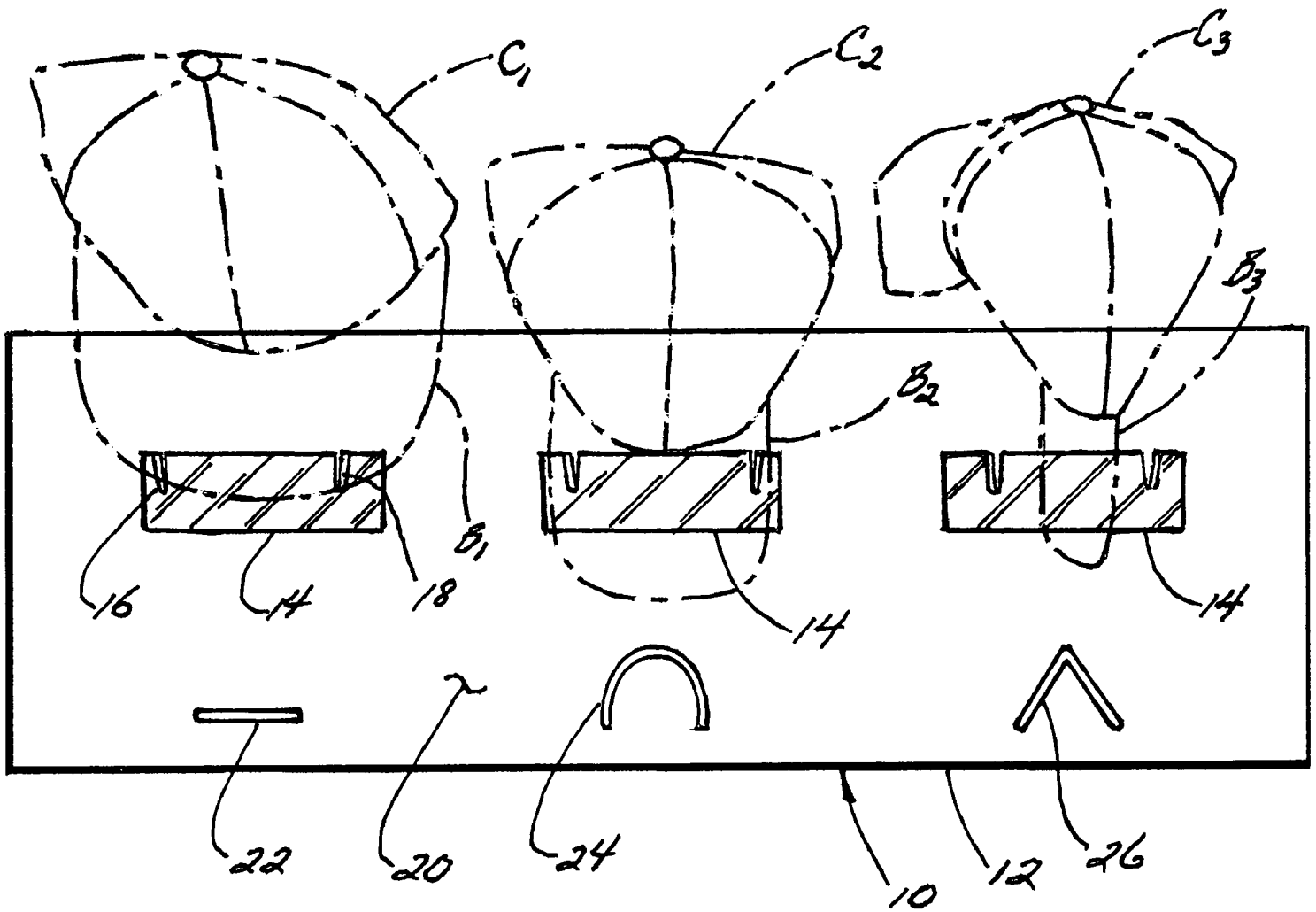
FIG. 1 is a front elevation view of one embodiment of the invention showing caps supportively engaged therein each having a unique bill configuration.
Figure 2:
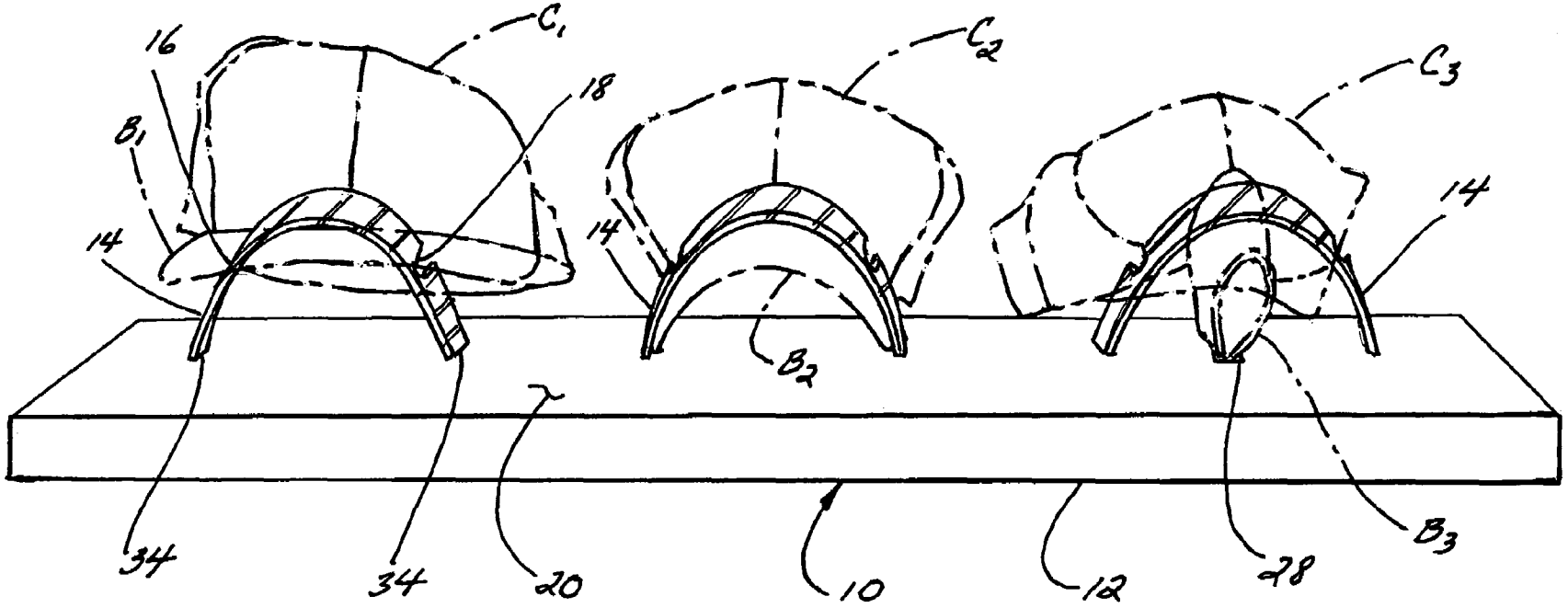
FIG. 2 is a bottom perspective view of FIG. 1.
Figure 3:
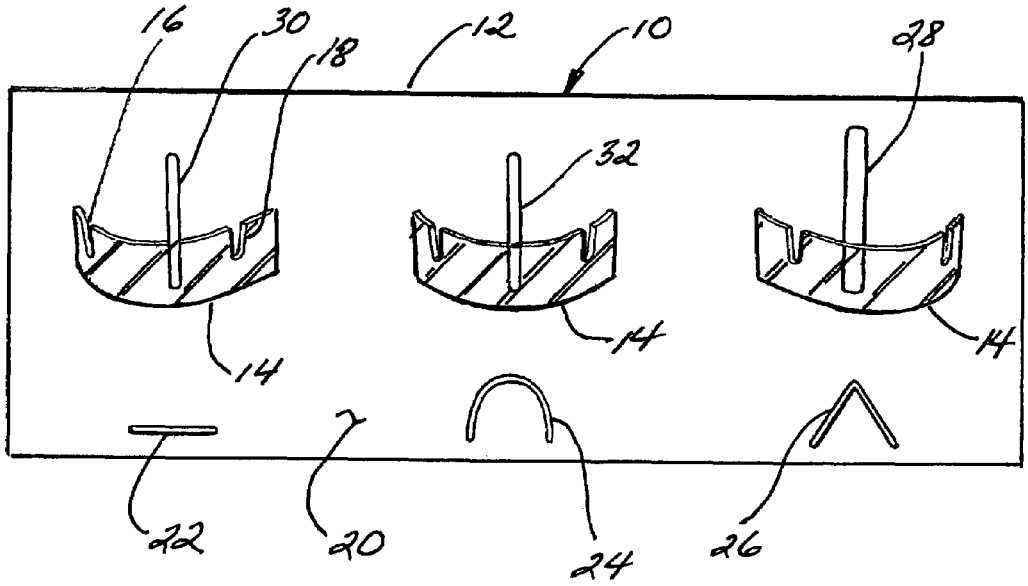
FIG. 3 is a view of the device of FIG. 1 absent the caps.
Figures 4, 5, 6:
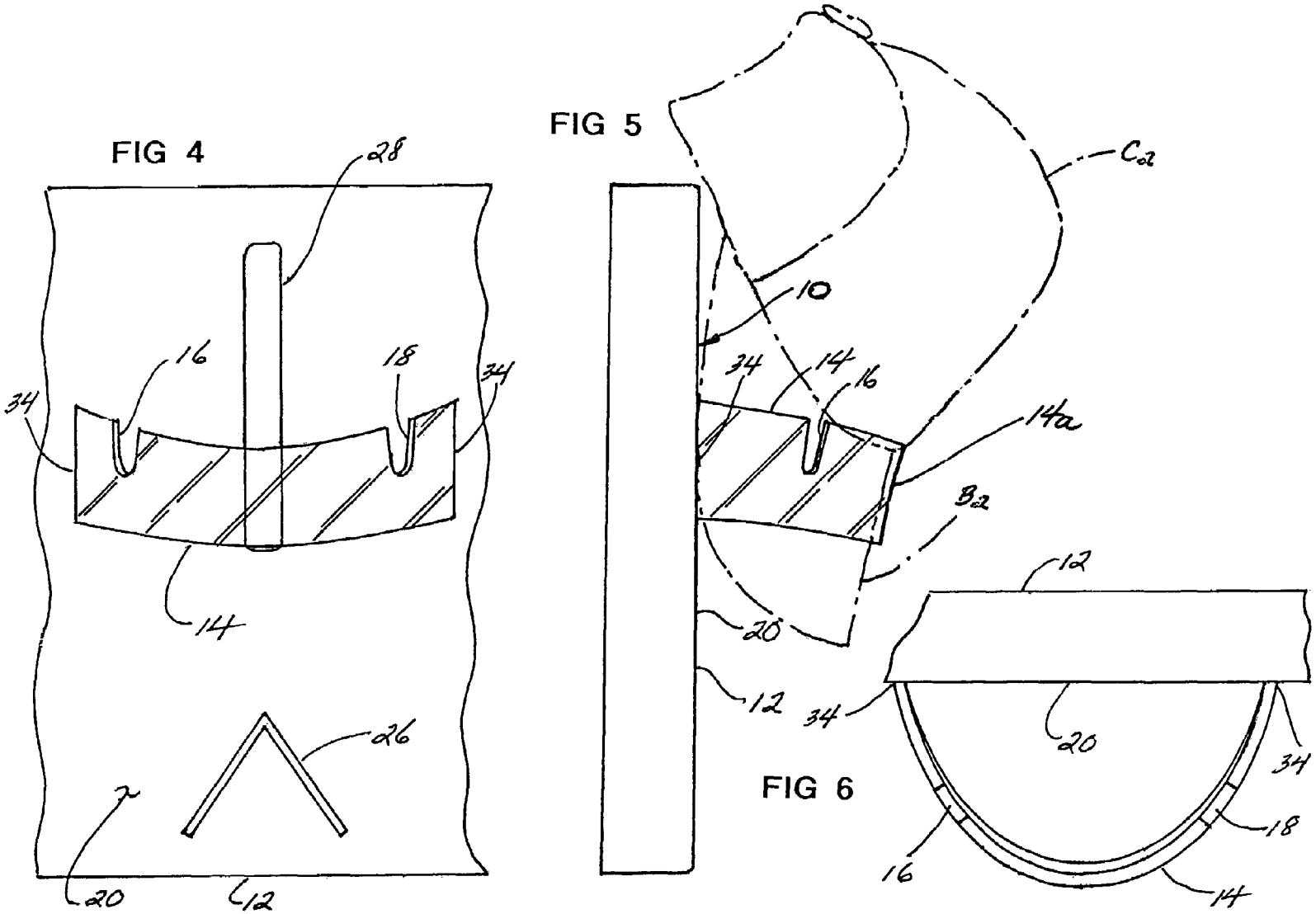
FIG. 4 is an enlarged view of one portion of FIG. 3.
FIG. 5 is an end elevation view of FIG. 3 showing one of the caps in phantom.
FIG. 6 is a top plan view of FIG. 5.

Referring now to the drawings, and particularly to FIGS. 1 to 6, one embodiment of the invention is there shown generally at numeral 10 and includes a rectangular base 12 having a depth, as best seen in FIGS. 2 and 5, of approximately 1.5" and formed of sheet plastic material having a generally flat display surface 20 which may be of various colors or simply transparent or translucent plastic material. The device 10 also includes a plurality of arcuately formed transparent plastic bands 14, each of which are attached at the ends thereof at 34 to the display surface 20 in an evenly spaced parallel array.

Each of the bands 14 has an arcuate form as best seen in FIG. 6 which is preferably elliptical and having slots 16 and 18 formed downwardly from the upper edge of each of the bands. These slots 16 and 18 are arranged symmetrically along each band 14 so that the front or distal edge of a bill $B_1$ of a generally flat or straight configuration of cap $C_1$ may be inserted into each of the slots 16 and 18 holding the cap $C_1$ in an upright orientation for viewing while also maintaining the shape of the bill $B_1$.

As best seen in FIG. 5, another of the bands 14 is utilized without using the slots 16 and 18 to hold a curved or U-shaped bill $B_2$ of cap $C_2$, by wedging the bill $B_2$ downwardly between the display surface 20 and the band 14 into the generally U-shaped configuration. Note, as best seen in FIG. 5, that the front or central portion $\mathbf{14}_a$ of the band 14 is tipped further away from the display surface 20 at the upper margin so that an angle of approximately 15° to the display surface 20 is established to best hold the bill $B_2$ in the position shown in FIG. 5 in phantom with the side edges of the bill $B_2$ held tightly against the display surface 20 and the inside ends at 34 of the band 14. Note that the bands 14 in this embodiment 10 are formed of transparent plastic material so that any indicia or coloring on the cap or bill is still viewable therethrough.

Viewable indicia 22, 24 and 26 are applied to the display surface 20 in proximity to the corresponding bands 14 so as to help or assist in utilizing the particularly configured bands with corresponding slots 28, 30 and 32 formed into the display surface 20 just beneath the corresponding bands 14. The straight indicia 22 is intended to represent utilizing that particular band 14 for holding a straight-billed cap $C_1$ while the U-shaped indicia 24 is a reminder to use the correspondingly proximate band 14 for curved bill hats $C_2$. The V-shaped indicia 26 is positioned in proximity to an elongated groove 28 formed transversely to the base 12 and beneath band 14 and is sized to receive the squeezed-together side margins of bill $B_3$ as best seen in FIG. 2. This groove 28 thus provides the means for forming and holding the bill $B_3$ in the folded configuration to help establish the fold as a permanent configuration of this cap $C_3$.

Figure 7:
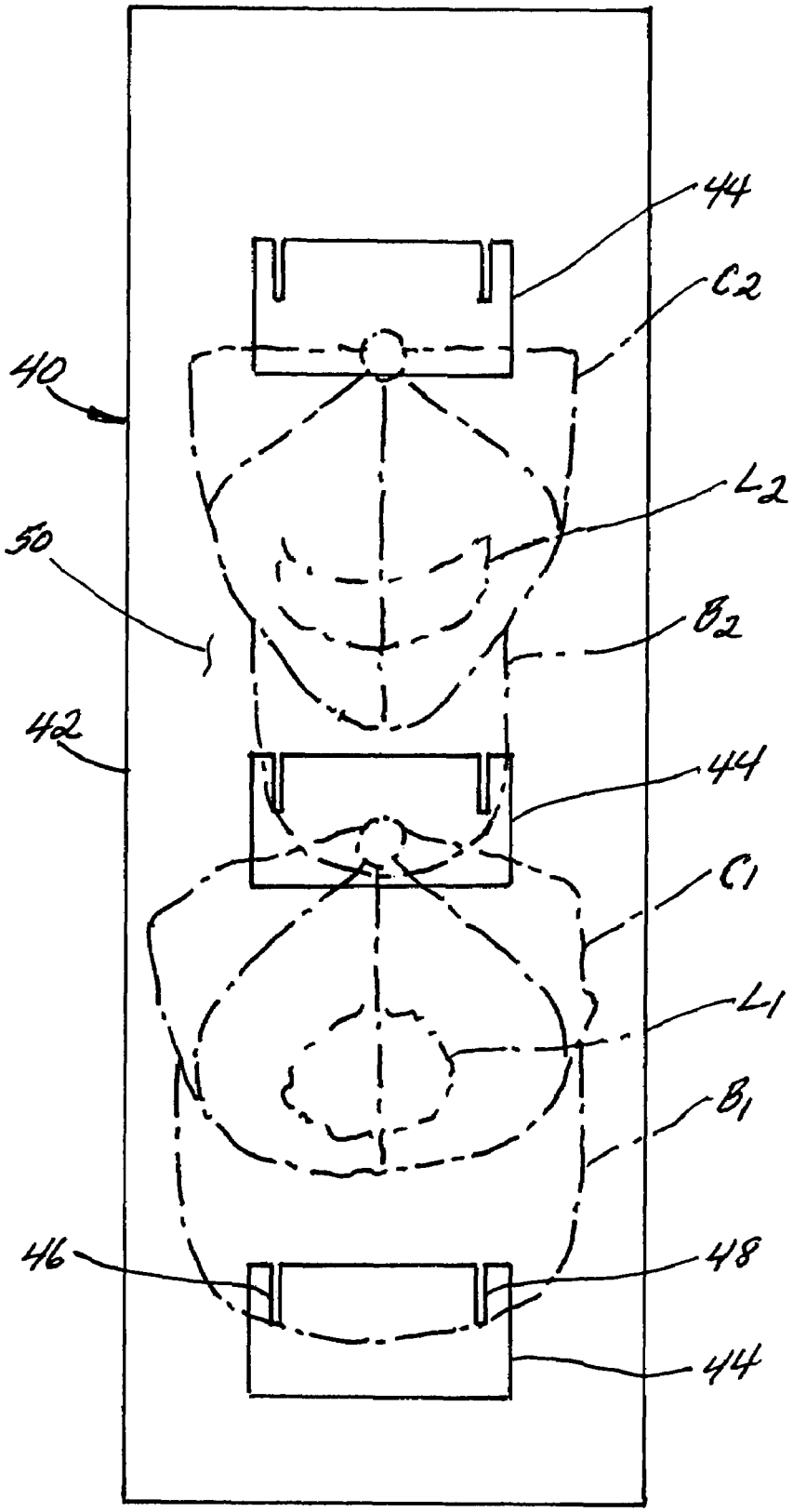
FIG. 7 is a front elevation view of another embodiment of the invention showing caps stored therein.

Referring now to FIG. 7, another embodiment of the invention is there shown generally at numeral 40, this embodiment 40 also including an upright elongated base 42 adapted for attachment to a vertical surface. This base 42 is likewise formed of flat opaque colored plastic material having a display surface 50 and a depth of approximately 1.5". This embodiment 40 also includes a plurality of semi-circular shaped bands 44, each having a cylindrical inner surface, all of which preferably aligned parallel to one another attached to the display surface 50.

Each of the bands 44 include symmetrically spaced slots 46 and 48 which are downwardly formed approximately half way through the width of each of the bands from the upper edge thereof. Cap $C_1$ has a generally straight bill $B_1$, the forwardly or distal edge of which is slidable snugly into both of the slots 46 and 48. Cap $C_2$ includes a U-shaped bill $B_2$ and is tightly fittable within the band 44 without the utilization of the slots 46 and 48 to establish and maintain the U-shaped bill $B_2$ configuration. Moreover, the viewable designs at $L_1$ and $L_2$ of each of the corresponding caps $C_1$ and $C_2$ are readily viewable when displayed in the device 40.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A cap holder and display device for caps having a bill comprising:

a base having a display surface;

a plurality of arcuately formed spaced apart bands each of which is connected at each end thereof to, and extending generally orthogonally from, said display surface;

each of said bands including two symmetrically spaced apart slots formed into a top edge of said band;

each of said bands arcuately configured, in conjunction with said display surface, to supportively receive, establish and retain, the curved shape of the bill of one cap;

said slots configured to receive, establish and retain the substantially straight distal edge of the bill of another cap.

2. A cap holder as set forth in claim 1, wherein:

a central transverse surface of each of said bands is further from said display surface at the top edge than at a bottom edge of said band.

3. A cap holder as set forth in claim 1, further comprising:

viewable indicia applied to said display surface adjacent to each of said bands, each of said indicia corresponding in shape to the shape of the cap bill configuration for each particular said band.

4. A cap holder and bill shape maintenance device comprising:

a base having an upright flat display surface;

a plurality of arcuately formed spaced apart bands each of which is connected at each end thereof to, and extending generally orthogonally from, said display surface;

each of said bands including two symmetrically spaced apart slots formed into a top edge of said band;

each of said bands arcuately configured, in conjunction with said display surface, to supportively receive, establish and maintain, the curved shape of the bill of one cap;

said slots configured to receive, establish and maintain the substantially straight distal edge of the bill of another cap;

an elongated groove formed through said display surface, said groove oriented generally orthogonal and opposingly positioned to one said band to receive side edges of a V-shaped bill of still another cap.

5. A cap holder as set forth in claim 4, wherein:

a central transverse surface of each of said bands is further from said display surface at the top edge than at a bottom edge of said band.

6. A cap holder as set forth in claim 4, further comprising:

viewable indicia applied to said display surface adjacent to each of said bands, each of said indicia corresponding in shape to the shape of the cap bill configuration for each particular said band.

* * * * *